US009521486B1

(12) United States Patent
Barton

(10) Patent No.: US 9,521,486 B1
(45) Date of Patent: Dec. 13, 2016

(54) FREQUENCY BASED BEAMFORMING

(71) Applicant: Amazon Technologies, Inc., Reno, NV (US)

(72) Inventor: William Folwell Barton, Harvard, MA (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 396 days.

(21) Appl. No.: 13/758,868

(22) Filed: Feb. 4, 2013

(51) Int. Cl.
*H04R 3/00* (2006.01)

(52) U.S. Cl.
CPC ..... *H04R 3/005* (2013.01)

(58) Field of Classification Search
CPC ..... H04R 1/1083
USPC ..... 381/94.7, 92, 94.1, 94.2
See application file for complete search history.

(56) References Cited

U.S. PATENT DOCUMENTS 8,958,572 B1 * 2/2015 Solbach ..... 381/94.7
2005/0249360 A1 * 11/2005 Adcock ..... H04R 3/005 381/92
2010/0014690 A1 * 1/2010 Wolff ..... H04R 3/005 381/92
2011/0274291 A1 * 11/2011 Tashev et al. ..... 381/94.1
2013/0315402 A1 * 11/2013 Visser ..... G10L 19/00 381/18

* cited by examiner

*Primary Examiner* — Sonia Gay
*Assistant Examiner* — Phan Le
(74) *Attorney, Agent, or Firm* — Seyfarth Shaw LLP; Ilan N. Barzilay; Alvin Y. Fashu-Kanu

(57) ABSTRACT

An acoustic device captures sound using two or more microphones and filters the sound into a plurality of sub-bands. For each of the plurality of sub-bands, the device identifies sound captured by the microphones from at least two directions and attenuates the sound captured by the microphones, within each of the sub-bands, in substantially one of the directions.

20 Claims, 9 Drawing Sheets

FREQUENCY BASED BEAMFORMING

BACKGROUND

Historically, communication devices, such as telephones, use a single omni-directional microphone intended to be located near the speaker to detect sound in a 360-degree uniform field. However, the farther the speaker is from the microphone, the lower the speaker's contribution to the captured audio becomes, resulting in reduced speech-to-noise ratio. This is a particular problem as the use of communication device such as speakerphones, conferencing devices and voice over IP (VOIP) systems has continued to increase.

Various techniques have been developed to attempt to increase the effective speech-to-noise ratio. One approach is to equip the communications device with one or more directional microphones, or two or more omnidirectional microphones, which allows the communication devices to capture noise by forming directional beams, which capture more of the desired signal, but less of the noise, thus increasing the signal-to-noise ratio. However, the processing required to direct multiple microphones is often computationally expensive and cost prohibit.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Overview

Figure 1:
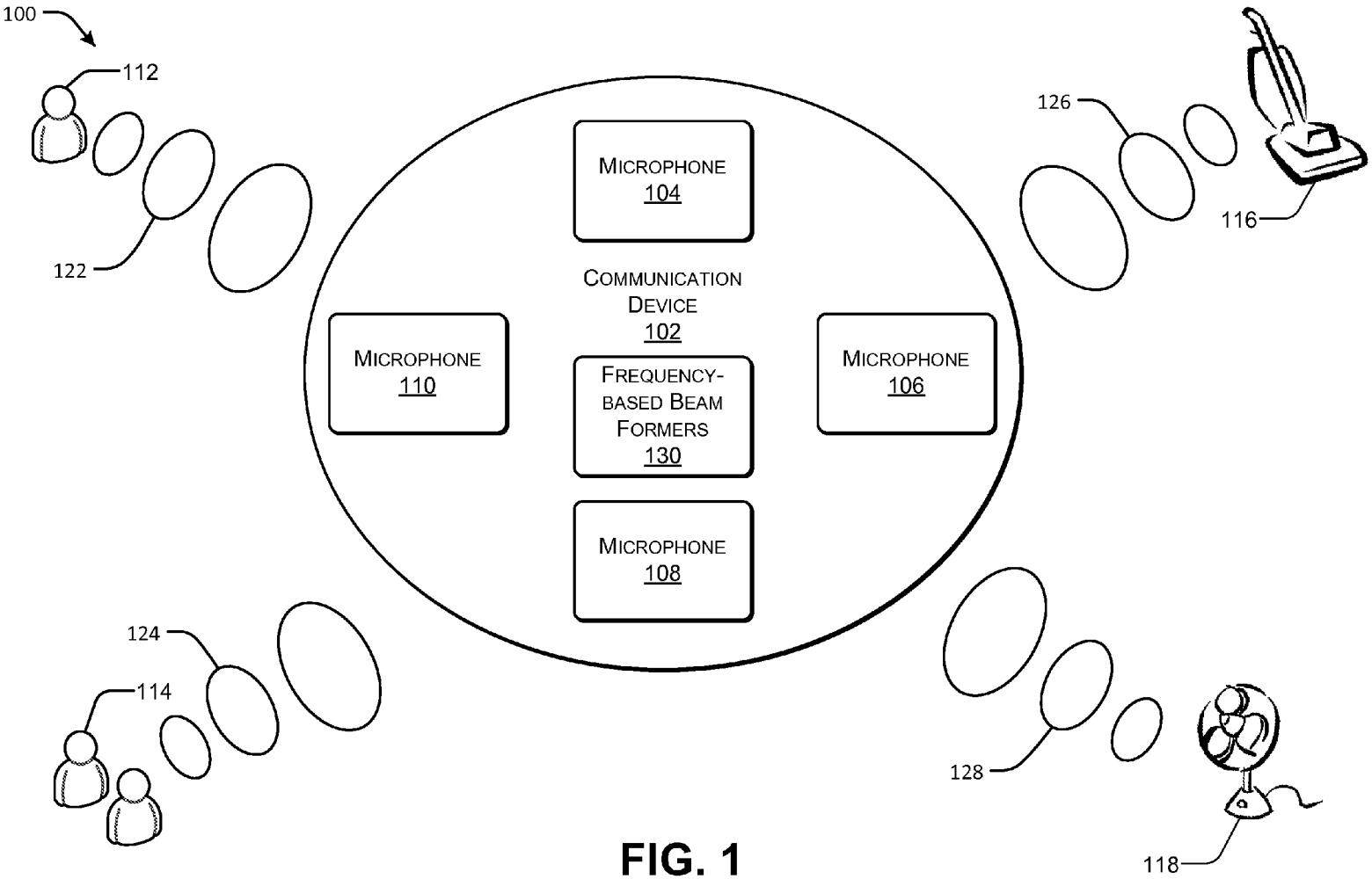
FIG. 1 illustrates an example acoustic environment including a communication device.

This disclosure includes techniques and implementations to improve acoustic performance of a communication device. One way to improve acoustic performance is to attenuate unwanted noise captured by the microphones of the communication device. In one example, beamforming techniques may be applied to shape the output of the microphones to attenuate the unwanted noise from specific directions. In general, beamforming applies weighted signals (or interference) to change the beam pattern (or sensitivity pattern) of the microphones or virtually within the output of the microphones by controlling delays and/or phase shifts in the frequency domain.

In general, the unwanted noise includes any noises that degrade or interferes with the speech to noise ratio with respect to the sounds captured by the device from the desired source (such as the user). The unwanted noise may include background noise, such as other speakers present in the room, a television broadcast, radio, appliance noise (such as a dishwasher or washing machine), etc. For example, if the communication device is a phone and the user is located in a room with an active television, the sound produced by the television and captured by the communication device is considered unwanted noise, as the sound produced by the television degrades the sound signal associated with the user.

By controlling the output signals of the microphones, directional acoustic nulls (e.g. a gap in the microphone outputs) and directional acoustic beams may be formed. In one technique, the outputs of each of the microphones are amplified by a variable weight or signal. By applying different weights at variable delays to different microphones signals, a desired pattern may be realized. Typically, as the weights are adjusted, the acoustical nulls and acoustical beams are steered or positioned in a desired orientation to amplify or attenuate sounds captured.

In one implementation, a beamforming process is employed to steer or form directional acoustic nulls and directional acoustic beams using multiple microphone outputs, such as is typically produced by a microphone array. The acoustic nulls may be steered in the direction from which unwanted noise is arriving. For example, forming an acoustic null may comprise attenuating sound captured by the microphones from the direction of the unwanted noise.

In one particular implementation, frequency based beamforming techniques may be applied to steer multiple frequency-specific directional acoustical nulls in the output of a microphone array. In this implementation, the sound signals captured by the microphone array are filtered into multiple frequency-specific sub-bands before processing. A relative direction of the strongest unwanted noise, other than the direction of the desired source, within each of the frequency-specific sub-bands may be determined and a directional acoustical null associated with the respective frequency formed in substantially the direction of the strongest unwanted noise. In this manner, multiple frequency-specific directional acoustical nulls, equal in number to the number of frequency sub-bands, can be steered independently of each other to attenuate unwanted noise from multiple sources.

Illustrative Environment

FIG. 1 illustrates an example acoustic environment 100 including a communication device 102. The communication device 102 may be implemented as any of a number of devices and in any number of ways, such as a wired or cellular telephone, a smart phone, a communication headset, a conferencing device, a speaker phone, a Bluetooth®-enabled device, a tablet, a computing device, or any number of other electronic devices capable of capturing sound at one or more microphones.

The communication device 102 is illustrated as including four microphones 104, 106, 108 and 110 to capture sound present in the acoustic environment 100. However, the communication device 102 may include any number of microphones, from 1 to N where N is a positive integer greater than 1. In the illustrated example, the four microphones 104-110 are arranged spatially around communication device 102, such that each microphone is arranged in relation to one another to correspond to each of the four main directions, although other arrangements are possible. For example, if the communication device 102 is embodied as a phone, the microphones may be more heavily clustered at the base of the device. In one particular example, each of the microphones 104-110 may be a microphone array or a calibrated group of microphones.

The communication device 102 also includes multiple frequency-based beamformers 130, which receive sound signals captured by microphones 104-110. Each of the frequency-based beamformers 130 is configured to analyze the captured sound signals within an associated frequency-sub band to determine the presence and relative direction of the desired source 112. The frequency-based beamformers 130 may determine the direction of the desired source 112 in a number of ways. For example, the frequency-based beamformers 130 may be configured to identify sound from a given orientation relative to the communication device 102 as the sound produced by the desired source 112, such as when a user speakers into a phone.

In another example, the frequency-based beamformers 130 may be configured to analyze the output of the microphone 104-110 to identify the desired source 112 based on a stored voice pattern associated with the desired source 112. In another example, the frequency-based beamformers 130 may be configured to identify sound within a predefined frequency range such as the ranges typically associated with a male's voice, female's voice and/or a child's voice, or to identify sound patterns typically associated with a male's voice, female's voice and/or a child's voice. Alternatively, the frequency-based beamformers 130 may analyze the output of the microphone 104-110 for the strongest signal and associate the strongest signal with the desired source 112. It should be understood that various other methods may be utilized by the communication device 102 to identify sound signal 122 associated with the desired source 112 within the output of the microphones 104-110.

The frequency-based beamformers 130 also determine the relative direction of the desired source 112 by comparing the delays associated with the sound signal 122 as captured by each of the microphones 104-110. For instance, communication device 102 includes four microphones 104, 106, 108 and 110. In the illustrated example, the sound signal 122 is captured by microphone 110 at a first time $t_1$, microphone 104 at a second time $t_2$ and microphone 108 at a third time $t_3$. Microphone 106 does not capture the sound signal 122, as the communication device 102 may obstruct the sound signal 122 with respect to microphone 106. The frequency-based beamformers 130 may then determine the relative direction of the desired source 112 using various triangulation methods. For instance, the communication device 102 may determine the direction by comparing the times $t_1$, $t_2$ and $t_3$, together, with the added information that the microphone 106 did not capture the sound signal 122 and the known location of the microphones 104-110 relative to the communication device 102.

Each of the frequency-based beamformers 130 is further configured to analyze the captured sound signals within an associated frequency-sub band to determine the presence and relative direction of strongest unwanted noise (i.e. any sound other than the sound signal 122 within the output of the microphones 104-110) within the frequency-sub band, other than the direction of the desired source 112. For example, the presence and relative direction of the unwanted noise may be determined by comparing the delays associated with the unwanted noise as described above.

In response to detecting the unwanted noise, each of the frequency-based beamformers 130 cause a frequency-specific directional acoustic null to form in the output signals to attenuate narrowband noise sources, which may be located within the associated frequency-sub band. In some instances, each of the frequency-based beamformers 130 may from acoustic nulls in different direction relative to the device. For example, each of the frequency-based beamformers 130 may form a frequency-specific directional acoustic null by digitally adding or subtracting weighted signals at various delays to the output signals to shape or modulate the output signals. For instance, a weighted signal may be added to the microphone outputs to substantially mitigate the noise from a direction. By adding and subtracting weighted signals to select microphone output signals, acoustical nulls may be placed to digitally form gaps in the beam pattern of the microphones 104-110 as represented by the output signals.

As illustrated, the acoustic environment 100 includes the communication device 102 surrounded by various sounds sources, such as the desired source 112 and other sound sources 114, 116 and 118. In the illustrated example, the desired source 112 is a user talking into or at the communication device 102, such as during a telephone conversation. The other sources 114, 116 and 118 are illustrated, respectively, as a conversation between other human speakers in the environment, a vacuum cleaner, and a fan (or other home appliance).

Each of the sound sources 112-116 generates a respective sound signal 122-128. Each of the sound signals 122-128 are captured by the communication device 102 from a different direction depending on the location of the sound source 112-116 relative to the communication device 102. Additionally, the frequency range of each of the sound signals 122-128 varies depending on the sound source 112-116.

The frequency-based beamformer 130 of the communication device 102 processes the captured sound signals 122-128 and attenuates the sound signals 124, 126 and 128 by steering multiple frequency-specific directional acoustic nulls in output signals of the microphones 104-110 in substantially the direction of each of the sound sources 124, 126 and 128. However, building communication devices with the computational power to independently steer multiple directional acoustic nulls and or beams may be prohibitively expensive for certain classes of devices.

In some communication devices, such as the communication device 102, the communication devices are configured to filter the captured sound signals 122-128 into multiple frequency-specific sub-bands for sub-band audio processing. In these communication devices a frequency-based beamformer may process the captured sound signals 122-128 within each of the frequency sub-bands. Thus, each of the frequency-based beamformers 130 may be configured to steer a single frequency specified directional acoustical null or beam within a specific frequency sub-band. In this manner, the computational expense of placing each additional directional acoustical null or beam is substantially mitigated, enabling construction of lower cost communication devices.

The microphones 104-110 capture sound signals 122-128 at different phases. Each of the N microphones 104-110 produce an associated audio signal (or microphone output) including the captured sound signals 122-128. Each of the microphone outputs are filtered by the communication device 102 into the K frequency sub-bands, such that there are K*N filtered signals (i.e. the number of sub-bands times the number of microphones).

Suppose for discussion purposes that, the desired sound source 112 is a male and that the sound signal 122 is captured from a first direction. Further, suppose that the sound source 114 consists of two females having a casual conversation and that the resulting sound signal 124 is captured from a second direction. Also, suppose that the vacuum cleaner sound source 116 produces a humming sound signal 126 captured from a third direction and that the fan motor, sound signal 118, produces a sound signal 128 captured from a fourth direction. Further, in this example, suppose that the communication device 102 is configured to filter the captured sound signals into multiple sub-bands.

As an example, each of the frequency-based beamformers 130 may analyze the noise within the respective frequency sub-band to determine which of the other sound sources 114, 116 or 118 is producing the greatest interference with respect to the sound signal 122. Upon identifying the most damaging other sound source (from a direction other than that of the desired source 112), each of the frequency-based beamformers 130 and may steer a frequency-specific directional acoustical null in substantially the direction of the identified other sound source 114, 116 or 118. By doing so, it is possible to substantially reduce the amount of unwanted noise present in the microphones outputs. For example within a sub-band associated with 800 Hz to 900 Hz, the frequency-based beamformer 130 assigned to this frequency sub-band may detect sound signal 124 from other sound source 114 and sound signal 128 from other sound source 118. In this sub-band, the frequency-based beamformer 130 may determine that the fan motor generating sound signal 128 is causing a greater reduction to the speech-to-noise ratio with respect to the sound signal 122 from the desired source 112 than is sound signal 124, the female voices. Therefore, the frequency-based beamformer 130, assigned to this frequency sub-band, may steer a frequency-specific directional acoustical null in substantially the direction of the other sound source 118. In another example, each of the frequency-based beamformers 130 may from a frequency-specific directional acoustical beam in substantially the direction of the desired source 112, in addition to or in lieu of placing the directional acoustical nulls. For instance, multiple frequency-based beamformers 130 detect the sound signal 122 from the desired source 112. Upon detection, each of multiple frequency-based beamformers 130 amplify sound signals captured from substantially the direction of the sound source 112.

Figure 2:
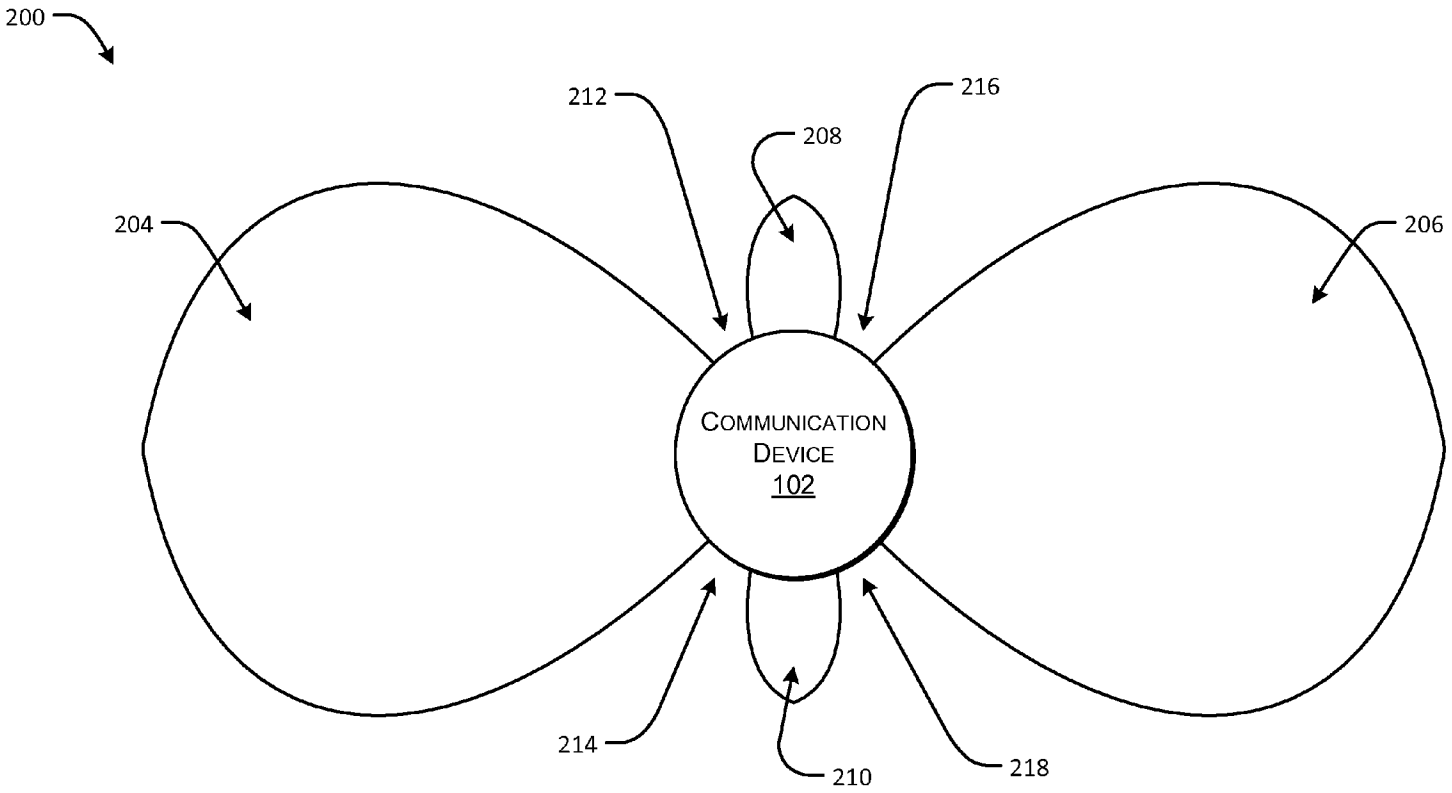
FIG. 2 illustrates an example beam pattern, at one example frequency, of a communication device.

FIG. 2 illustrates an example beam pattern 200, at one example frequency, of the communication device 102. Typically, a beam pattern includes at least one main acoustical beam together with various acoustical nulls and side beams. The microphones capture sound signals passing through the beam pattern at varying attenuations based largely on the location and orientation of the acoustical nulls and the acoustical beams. The beam pattern of a microphone group or array varies depending on the calibration, type, and/or sensitivity of the microphones, among other factors. The beam pattern of a microphone group or array also varies over the range of the frequency domain. Therefore, it should be understood that the beam pattern of a given microphone group or array provides different patterns depending on the frequency considered.

The beam pattern 200 includes two main directional acoustical beams 204 and 206 and two side beams 208 and 210. The beam pattern also illustrates several directional acoustical nulls 212, 214, 216 and 218. In some instances, the directional acoustical nulls 212-218 are naturally occurring based on the microphones type, arrangement and calibration. In other instance, the directional acoustical nulls may be introduced to the microphone outputs signals using beamforming and audio processing techniques. For instance in the illustrated example, the microphone 108 of FIG. 1 is responsible for generating the side beam 208, which may only be capturing sound signals 124 and 128 (both of which are unwanted noise). The communication device 102 may then apply beamforming techniques to introduce an acoustical null in lieu of side beam 208. For example, the communication device 102 may add an signal representing the inverse of the output of the microphone 108 to the microphone outputs to form the acoustic null in place of the side beam 208. Thus, any sound captured by the side beam 208 is removed from the microphone outputs.

According to some implementations, the communication device 102 filters the microphone outputs into a plurality of frequency-specific sub-bands and independently analyzes each of the frequency-specific sub-bands to determine a direction of unwanted noise present within the microphone outputs. The communication device 102 further causes, for each frequency-specific sub-band, a frequency-specific directional acoustical null to form in substantially the direction of the strongest unwanted noise originating from a direction other than that of sound signal associated with a desired source.

Illustrative Systems

Figure 3:
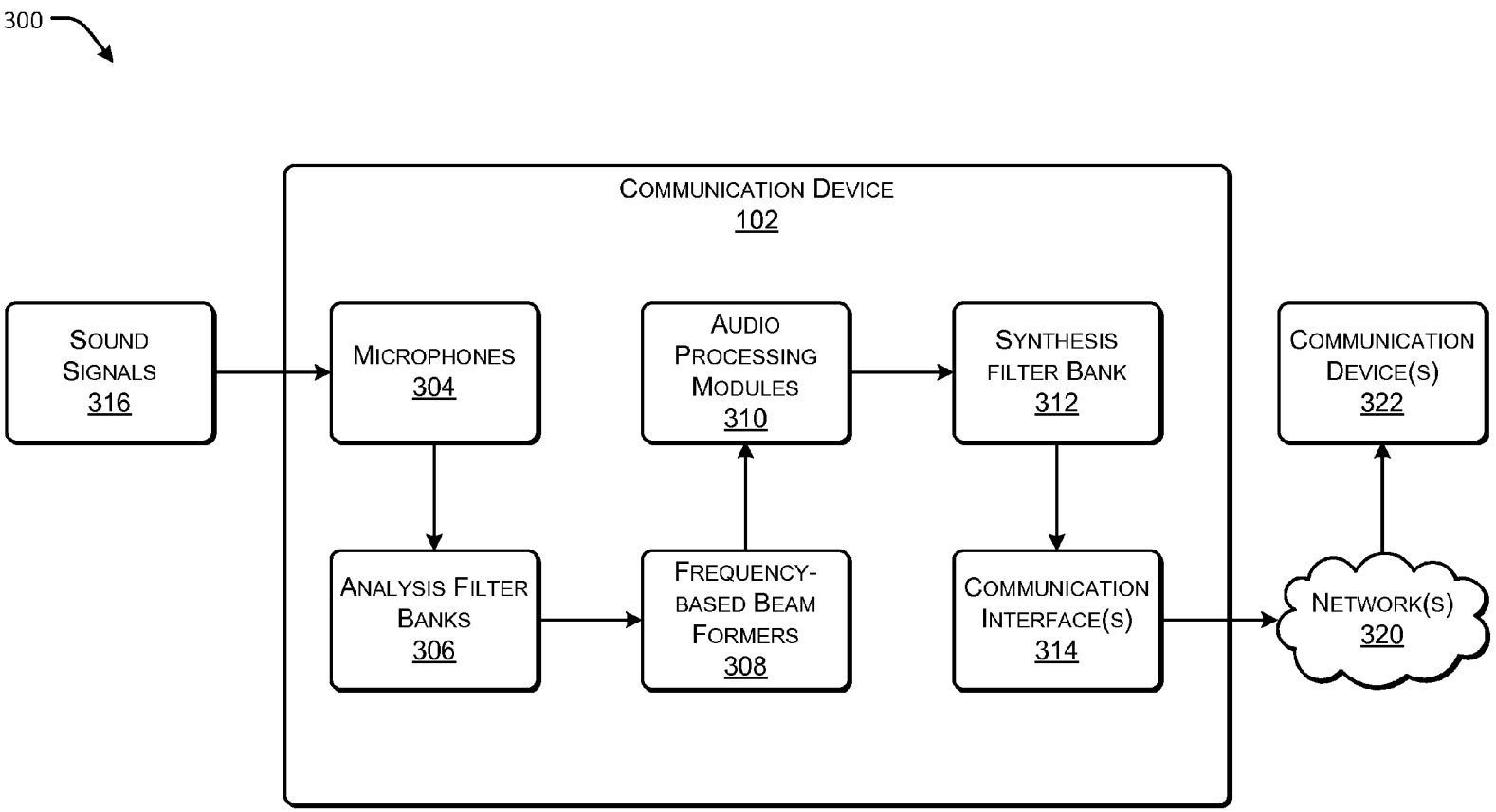
FIG. 3 illustrates an example of a system including a communication device.

FIG. 3 illustrates an example of a system 300 including the communication device 102. Generally, the communication device 102 includes two or more microphones 304, analysis filter banks 306, multiple frequency-based beamformers 308, audio processing modules 310, a synthesis filter bank 312, and one or more communication interfaces 314.

The microphones 304 may be a microphone array, a calibrated group of microphones, or multiple microphone arrays or calibrated groups. In general, the microphones 304 capture sound signals 316 passing through the acoustic environment. In some examples, microphones 304 may be incorporated with an analog-to-digital converter to convert the sound signal 306 into digital audio signals for processing.

Each of the analysis filter banks 306 is configured to receive microphone output signals representative of sound signals 306 captured by the microphones 304, such that there is a one to one correspondence between the analysis filter banks 306, microphone output signals and the microphones 304. The analysis filter banks 306 are configured to filter the microphone output signals into a plurality of frequency-specific sub-bands, such that individual audio processing may be performed on each sub-band. For example, one technique to filter the output signals includes using multiple band pass filters to generate the sub-bands.

As discussed above, each of the frequency-based beamformers 308 correspond to a particular frequency sub-band. Each of the frequency-based beamformers 308 is configured to receive a signal associated with that frequency sub-band from each of the analysis filter banks 306 and to analyze the audio captured within the frequency sub-band. During the analysis, each of the frequency-based beamformers 308 determine the presence of the strongest unwanted noise within the frequency sub-band and identifies a general direction of the source of the unwanted noise relative to the communication device 102. Upon determining the presence and direction, the respective frequency-based beamformer 308 steers a frequency-specific directional acoustic null in substantially that direction. For example, the frequency-based beamformer 308 may apply interface signals or delays to the signal associated with that frequency sub-band to form an acoustic null within the corresponding sub-band.

The audio processing modules 310 are also configured to receive the plurality of frequency sub-bands. The audio processing modules 310 may perform various other audio processing techniques to the frequency sub-bands, such as applying noise cancellation algorithms, clipping, echo and feedback cancellation or compression. In another implementation, the audio processing modules 310 may be configured to pre-process the microphone outputs before the frequency-based beamformers 306 steer the directional acoustical nulls to attenuate unwanted noise.

The synthesis filter bank 312 is configured to receive the processed frequency sub-bands and to combine the sub-bands back into a single processed audio signal for transmission by at least one of the communication interfaces 314. The communication interfaces 314 are configured to provide the processed audio signal over one or more networks 320 to one or more other communication devices 322. The communication interfaces 314 may support both wired and wireless connection to various networks, such as cellular networks, radio, WiFi networks, short-range or near-field networks (e.g., Bluetooth®), infrared signals, local area networks, wide area networks, the Internet, and so forth.

In one example, microphones 304 capture sound signals 316 from various sound sources, including a desired sound source, present in the acoustic environment surrounding the communication device 102. The captured sound signals 316 are filtered into multiple frequency sub-bands by analysis filter banks 306. The number of frequency sub-bands may vary depending on the sample rate of microphones 304 and types of audio processing to be performed on the sub-bands.

Each of the sub-bands are processed by one of the frequency-based beamformers 308 and one of the audio processing modules 310. However, the order of processing may vary from device to device. Each of the audio processing modules 310 may perform various known audio processing techniques depending on the type and purpose of the communication device 102. For example, many speakerphones perform acoustic echo cancellation to reduce loudspeaker feedback in the processed microphone signal. The processed audio signals are combined by synthesis filter bank 312 and communicated to at least one of the communication devices 322 over at least one of the networks 320 via the communication interfaces 314.

Each of the frequency-based beamformers 308 analyzes one of the sub-bands to determine if unwanted noise is present in the corresponding frequency range. If one of the frequency-based beamformers 308 determines that unwanted noise is present within the corresponding frequency sub-band, than the frequency-based beamformer 308 identifies a direction of the strongest unwanted noise relative to the communication device 102, from a direction other than the direction of the sound signal from the desired source.

Once the direction of the strongest unwanted noise is identified, the respective frequency-based beamformers 308 steers or forms a directional acoustic null within the sub-band in substantially the direction of the strongest unwanted noise. Thus, further sound signals captured by the microphones 304 from the direction of the strongest unwanted noise within the frequency sub-band is attenuated. It should be understood, that each of the frequency-based beamformers 308 continuously detects, determines the direction of and attenuates unwanted noise.

In an example, each of the frequency-based beamformers 308 determine the direction of the sound signal from the desired source and the direction to the strongest unwanted noise, which is not from the same direction as the sound signal from the desire source. Each of the frequency-based beamformers 308 then form a frequency-specific directional acoustic beam pattern, which maximizes the contribution of the sound signal from the desired source and minimizes the contribution of the unwanted noise.

Figure 4:
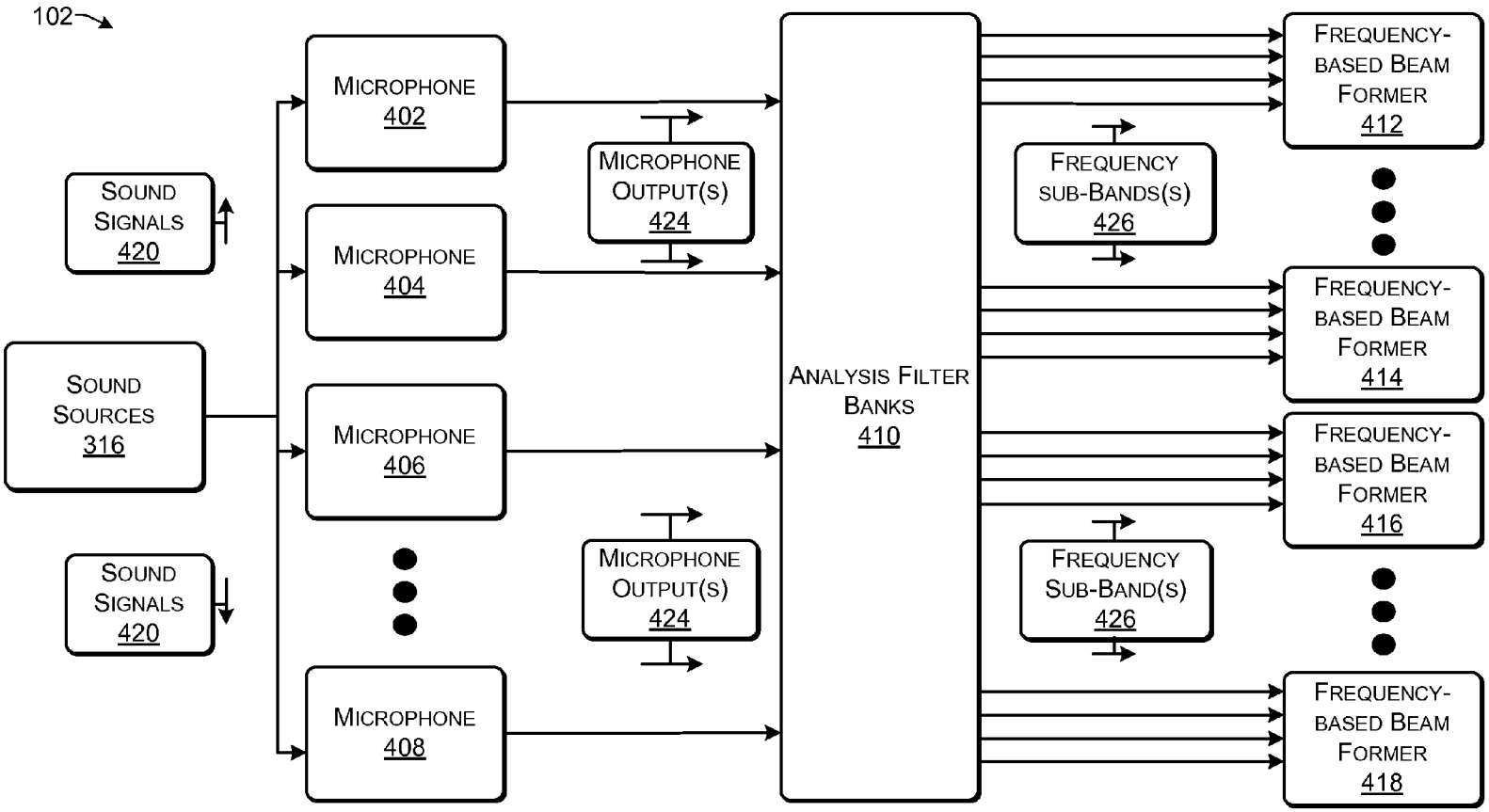
FIG. 4 illustrates an example of select components of the communication device.

FIG. 4 provides a more detailed example implementation of the communication device 102 of FIG. 3 by illustrating how multiple microphones and multiple frequency-based beamformers may be used to attenuate unwanted noise.

FIG. 4 illustrates an example of select components of the communication device 102. The communication device 102 includes two or more microphones from 1 to N, illustrated as microphones 402, 404, 406 and 408, two or more analysis filter banks 410 from 1 to N (each filter bank correspond to one of the microphones from 1 to N) and two or more frequency-based beamformers from 1 to K, illustrated as frequency-based beamformers 412, 414, 416 and 418.

The microphones 402-408 capture sound signals 316 from multiple sound sources 422 surrounding the communication device 102 and convert the sound signals 316 into microphone outputs 424. The sound signals 316 captured by each microphone 402-408 at a given time vary based on direction, placement and type of microphone.

Each of the analysis filter banks 410 receives a microphone output 424 from one of the microphones 402, 404, 406 or 408 and filters the microphone output 424 into two or more frequency-specific sub-bands 426 from 1 to K corresponding to the number of frequency-based beamformers 412-418. Thus, each of the analysis filter banks 410 receives one of the N microphone outputs 424 and generates K frequency sub-bands 426, as such there are N*K frequency sub-bands signals produced.

Each of the frequency-based beamformers 412-418 receives N frequency sub-bands 426 (i.e. one frequency sub-band 426 from each of the analysis filter banks 410). Each of the frequency-based beamformers 412-418 process one of the received frequency sub-bands 426. During the processing, each of the frequency-based beamformers 412-418 analyzes one of the received frequency sub-bands 426 to determine if there are any sound signals 316 captured by microphones 402-408 within the sub-band besides sound signals from the desired source. If there are any additional sound signals 316 (unwanted noise) captured by microphones 402-408, the respective frequency-based beamformer 412-418 determines a substantial direction of the strongest sound signals 316 from a direction other than that of the direction of the sound signals from the desired source.

Once the direction of the strongest unwanted sound signals 316 are determined, the respective frequency-based beamformer 412-418 forms a directional acoustical null within the frequency sub-band in substantially the direction of the sound signals 316. In this manner, K independent frequency-specific directional acoustical nulls may be formed to attenuate the unwanted noises. Because many sound sources generate sound signals within a narrow range of frequencies, each source of unwanted noise may be minimized by one or a small number of the frequency-based beamformers 130. Thus by utilizing the frequency-based beamformers 130, the communication device 102 may attenuate unwanted noise from a number of sound sources up to the number of frequency sub-bands.

Figure 5:
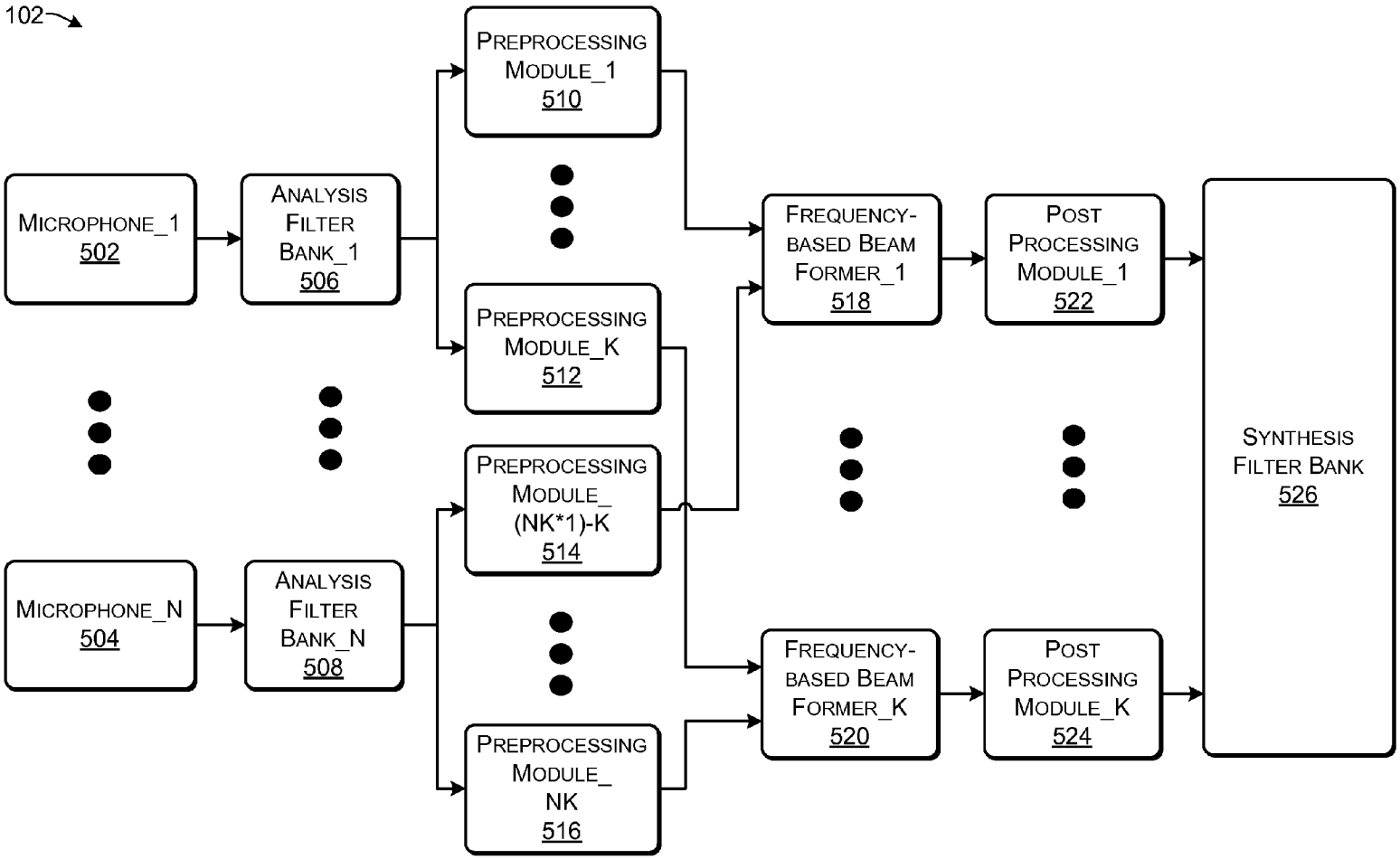
FIG. 5 illustrates a second example of select components of the communication device.

FIG. 5 provides a more detailed example implementation of the communication device 102 of FIG. 3 by illustrating how the output of each microphone is processed to form or steer multiple frequency-specific acoustic nulls.

FIG. 5 illustrates a second example of select components of the communication device 102. The communication device 102 includes multiple microphones from 1 to N, for example microphone_1 502 and microphone_N 504. The communication device 102 also includes analysis filter banks from 1 to N, for example analysis filter bank_1 506 and analysis filter bank_N 508. Each of the microphones from 1 to N correspond to one of the analysis filter bank from 1 to N. Thus, microphone_1 502 provides a microphone output to analysis filter bank_1 506 and microphone_N 504 provides a microphone output to analysis filter bank_N 508. Each of the analysis filter banks 1 to N produce K filtered signals, where K is the number of frequency sub-bands being processed by the communication device 102.

In the illustrated embodiment, the communication device 102 further includes multiple preprocessing modules from 1 to NK, for example preprocessing module_1 510, preprocessing module_K 512, preprocessing module_(NK+1)-K 514 and preprocessing module_NK 516. Each of the analysis filter banks from 1 to N provides a filtered signal to a set of preprocessing modules. For example, analysis filter bank_1 506 provides a filtered signal to preprocessing module_1 510 through preprocessing module_K 512 and analysis filter bank_N 508 provides a filtered signal to preprocessing module_(NK_1)-K 514 through preprocessing module_NK 516. Each of the preprocessing modules from 1 to NK produce a conditioned signal. It should be understood that in some implementations fewer preprocessing modules may be utilized. For example, one preprocessing module may process all of the signals from the analysis filter banks from 1 to K within a specific frequency sub-band.

In the illustrated embodiment, the communication device 102 includes multiple frequency-based beamformers from 1 to K, for example frequency-based beamformer_1 518 and frequency-based beamformer_K 520. Each of the frequency-based beamformers 1 to K receives N conditioned signal from N of the preprocessing modules from 1 to NK. Each of the frequency-based beamformers from 1 to K shape the conditioned signals by placing or forming a frequency-specific directional acoustical null to attenuate unwanted noise to generate K beamformed signals based on the direction of strongest unwanted noise present originating from a direction other than the direction of the desired signals.

The communication device 102 further induces multiple post processing modules from 1 to K, for example post processing module_1 522 and post processing module_K 524. Each of the post processing modules 1 to K receives a beamformed signals from one of the frequency-based beamformers from 1 to K and further processes the signal to generate a frequency-specific output signal.

The communication device 102 also includes a synthesis filter bank 526, which receives all of the frequency-specific output signals from the post processing modules 1 to K. The synthesis filter bank 526 combines the frequency-specific output signals into one output signal, which may be transmitted to one or more other devices or provide to a speaker for output as audible sound.

Figure 6:
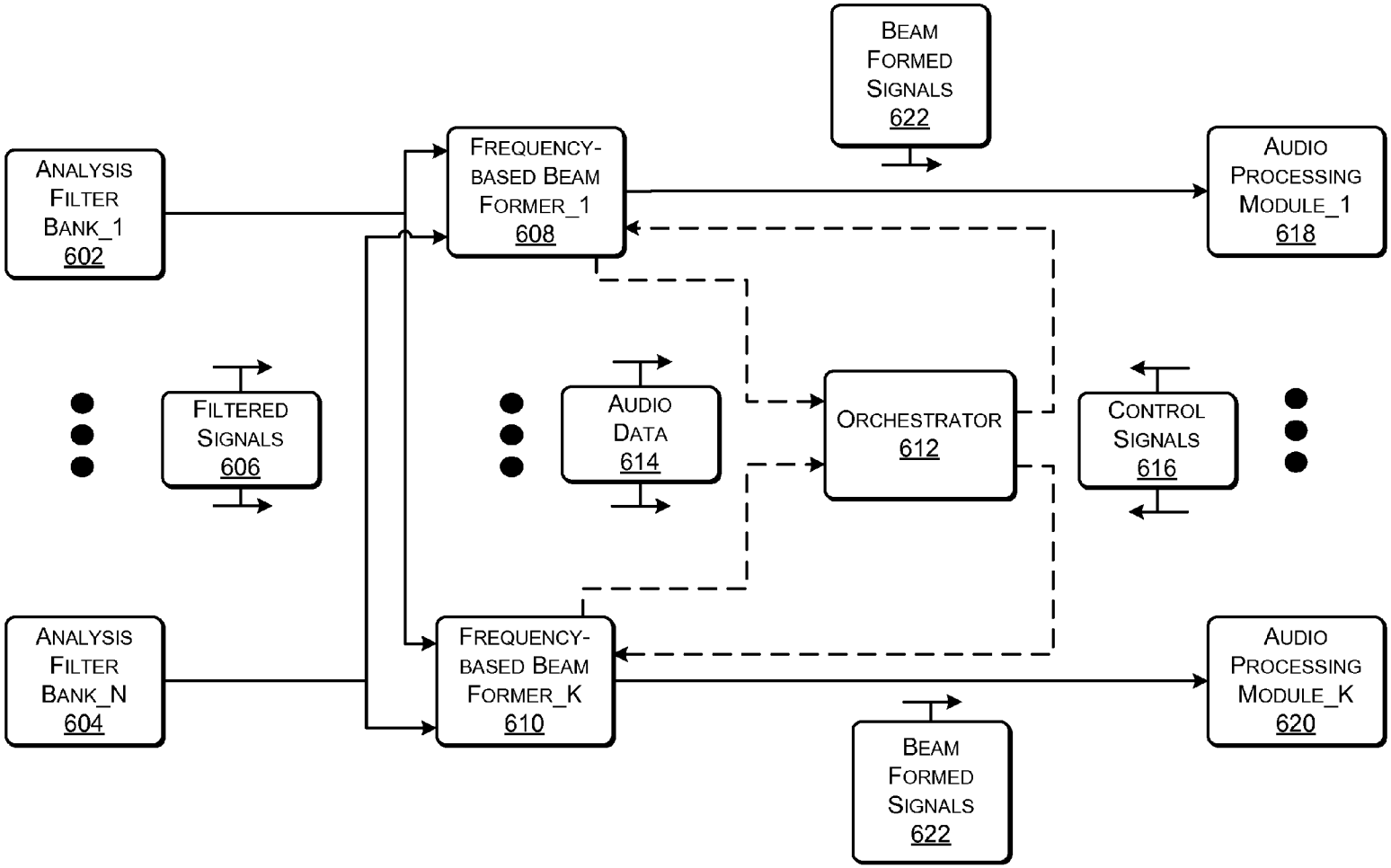
FIG. 6 illustrates a third example of select components of the communication device.

FIG. 6 illustrates a third example of select components of the communication device 102. The communication device 102 includes multiple analysis filter banks from 1 to N, for example analysis filter bank_1 602 and analysis filter bank_N 604. Each of the analysis filter banks 1 to N generate K filtered signals 606, as discussed above.

In the illustrated embodiment, the communication device 102 includes multiple frequency-based beamformers from 1 to K, for example frequency-based beamformer_1 608 and frequency-based beamformer_K 610. Each of the frequency-based beamformers 1 to K receives N filtered signals, one from each of the analysis filters from 1 to N. Each of the frequency-based beamformers from 1 to K are also in communication with an orchestrator 612. The orchestrator 612 receives audio data 614 (such as sound signals related to the unwanted sources, sound signals related to the desired source, energy associated with the corresponding frequency sub-band, etc.). In return, the orchestrator 612 provides control signals 614 to at least some select frequency-based beamformers from 1 to K to cause the selected frequency-based beamformers to generate an acoustic beam pattern across multiple sub-bands, such that the directional acoustical nulls and beams work together to achieve the greatest speech-to-noise ratio. For example, the orchestrator 612 may be configured to determine the diction of the desired source based on an analysis of the microphone outputs across the entire frequency range. For instance, by identifying the strongest signal over the entire frequency range and associating the strongest signal with the desired source.

The communication device 102 further induces multiple audio processing modules from 1 to K, for example audio processing module_1 618 and audio processing module_K 620. Each of the audio processing modules from 1 to K receives a beamformed signals 622 from one of the frequency-based beamformers from 1 to K and further processes the signal to generate a frequency-specific output signal. In some examples, it should be noted that the audio processing of audio processing modules 618 and 620 may be preformed prior to beamforming.

In general, each of the analysis filter banks 1 to N generate K filtered signals 606, which are provided to the corresponding frequency-based beamformer from 1 to K. Each of the frequency-based beamformer from 1 to K, provide audio data 614 to the orchestrator 612. The orchestrator 612 analyzes the energy associated with each frequency sub-band and provides control signals 616 to at least some of the frequency-based beamformers from 1 to K to cause the selected frequency-based beamformers to generate a beam pattern in conjunction with each other and/or override the normal beamforming procedures as described above.

For example, a user of the communication device 102 may be the desired source and the user's voice may span most of the frequency ranges. For example purposes, let us assume the user is wearing a monitor (such as a heart monitor), which emits a tone around 1850 Hz but is generated from the same direction as the user's voice. The orchestrator 612 may receive the audio data 614 from the frequency-based beamformer associated with the frequency 1850 Hz including data related to the user's voice and the monitor. The orchestrator 612 may determine from the audio data 614 provided by all of the frequency based beamformers from 1 to K that the tone at 1850 Hz is affecting the overall speech-to-noise ratio associated more than placing a directional acoustical null within the frequency sub-band would. In this example, the orchestrator 612 may provide control signals 616 to the frequency based-beamformer associated with the frequency sub-band to form a directional acoustical null in the direction of the desired source to attenuate the tone.

In another example, the orchestrator 612 may detect an unwanted noise from a first direction that spans two sub-bands and causes the most significant degradation to the speech-to-noise ratio. However, the strongest unwanted noise in either individual sub-band may be from a second and a third direction, respectively. The orchestrator 612 may analyze the audio data 614 and determine that the unwanted noise from the first direction should be attenuated instead of the unwanted noise from the second and third directions. The orchestrator 613 may then provide control signals 616 to the frequency based beamformers associated with both sub-bands to form the directional acoustical nulls in the first direction rather than in the second and third directions as described above.

Figure 7:
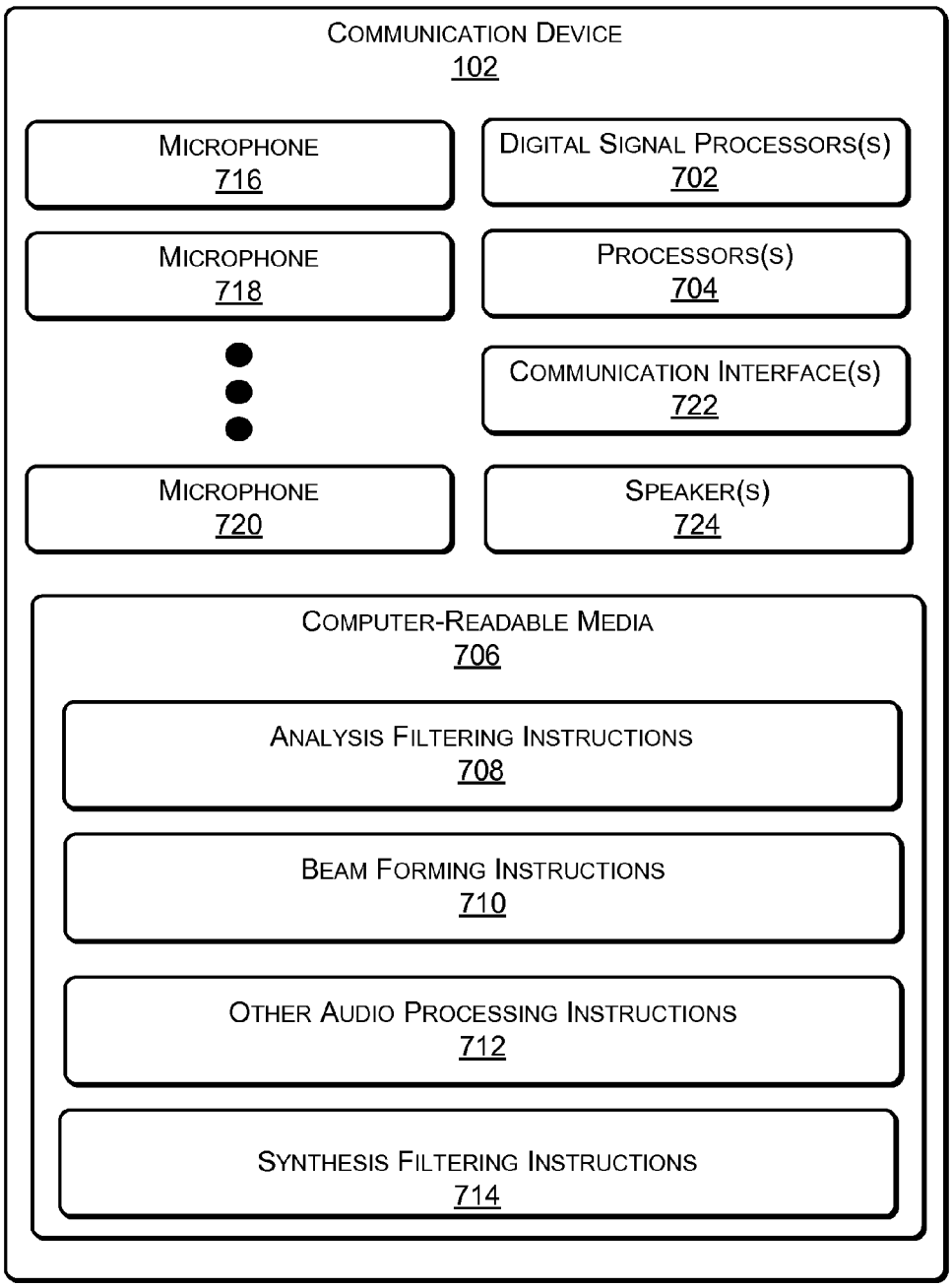
FIG. 7 illustrates another example communication device.

FIGS. 3, 4, 5 and 6 provide example implementations using modules to steer directional acoustical nulls and directional acoustical beams. FIG. 7 provides another example implementation using software and a digital signal processor to perform the audio processing and frequency based beamforming techniques as described in FIGS. 3, 4 and 5.

FIG. 7 illustrates another example the communication device 102. In one configuration, the communication device 102 includes, or accesses, components such as at least one control logic circuit, central processing unit, the digital signal processor 702 and/or the processor 704, in addition to one or more computer-readable media 706 to perform the function of the communication device 102 in software. Each of the processors 702 or 704 may itself comprise one or more processors or processing cores. Depending on the configuration of the communication device 102, the computer-readable media 706 may be an example of tangible non-transitory computer storage media and may include volatile and nonvolatile memory and/or removable and non-removable media implemented in any type of technology for storage of information such as computer-readable instructions, data structures, program modules or other data. Such computer-readable media may include, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the digital signal processor 702 or the processor 704 directly or through another computing device. Accordingly, the computer-readable media 706 may be computer-readable media able to store and maintain instructions, modules or components executable by either the digital signal processor 702 or the processor 704.

Functional components are shown stored in the computer-readable media 706 and may be executed on the digital signal processor 702 and/or processor 704. The functional components may include, for example, an analysis filtering instructions 708, beamforming instructions 710, and other audio processing instructions 712, and synthesis filtering instructions 714. Depending on the type of the communication device 102, the computer-readable media 706 may also optionally include other functional components, such as other modules, which may include applications, programs, drivers and so forth.

The communication device 102 further includes two or more microphones from 1 to N, illustrated as microphones 716, 718 and 720. The microphones 716-720 may be a calibrated microphone group, more than one calibrated microphone group, or one or more microphone arrays. Each of microphones from 1 to N captures sound signals from various direction and sound sources in the acoustic environment and converts the sound signals into microphone output signals. In one example, the communication device 102 may be equipped with one or more analog-to-digital converters (not shown) to produce a digital microphone output from the microphone output signals of microphones 1 to N. The digital microphone output may then be processed by digital signal processor 702 by executing the analysis filtering instructions 708, beamforming instructions 710, and other audio processing instructions 712, and synthesis filtering instructions 714. In another example, the microphones 716-720 may be configured, or integrated with the analog-to-digital converters, to directly generate the digital microphone outputs.

The communication device 102 further includes one or more communication interfaces 722, which may support both wired and wireless connection to various networks, such as cellular networks, radio, WiFi networks, short-range or near-field networks (e.g., Bluetooth®), infrared signals, local area networks, wide area networks, the Internet, and so forth. For example, the communication interface 720 may allow a user of the communication device 102 to access the conduct a telephone conference with one or more other individuals.

The communication device 102 also includes one or more speakers 724 to reproduce audio signals as audible sound. For example, the speakers 724 may be used in conjunction with the communication interfaces 720 to hold a conversation with the one or more other individuals.

The communication device 102 may further be equipped with various other input/output (I/O) components (not shown). Such I/O components may include a touch screen and various user controls (e.g., buttons, a joystick, a keyboard, a mouse, etc.), speakers, a microphone, a camera, connection ports, and so forth. For example, the operating system of the communication device 102 may include suitable drivers configured to accept input from a keypad, keyboard, or other user controls and devices included as the I/O components. For instance, the user controls may include navigational keys, a power on/off button, selection keys, and so on. Additionally, the communication device 102 may include various other components that are not shown, examples of which include removable storage, a power source, such as a battery and power control unit, and so forth.

In one implementation, the microphones 716-720 capture sound signals from multiple directions. The captured sound signals are processed by the digital signal processor 702 according to the analysis filtering instructions 708, beamforming instructions 710, and other audio processing instructions 712, and/or synthesis filtering instructions 714.

The digital signal processor 702 filters the captured sound signals according to the analysis filtering instructions 708. The analysis filtering instructions 708 cause the digital signal processor 702 to filter the captured sound signals into multiple frequency sub-bands from 1 to K corresponding to the number of directional acoustical nulls or beams desired. For example, the communication device 102 may filter the captured sound signals into 100 Hz frequency sub-bands.

The digital signal processor 702 applies the null forming instructions 712 to each of the frequency sub-bands 1 to K. The null forming instructions 712 cause the digital signal processor 702 to determine if there is any unwanted noise within the frequency sub-band. If there is unwanted noise, the beamforming instructions 710 further cause the digital signal processor 702 to determine a relative direction of the strongest unwanted noise with regards to the communication device 102 from a direction other than that of the desired source. The null forming instructions 712 then cause the digital signal processor 702 to form a directional acoustical null in substantially the direction of the unwanted noise. It should be understood that in this example, the beamforming instructions 710 may form a plurality of frequency-specific directional acoustical corresponding to the number of frequency sub-bands 1 to K.

The digital signal processor 702 may also apply other audio processing instructions 712 to the captured sound signals. In one example, the digital signal processor 702 applies the other audio processing instructions 712 to each of the frequency sub-bands 1 to K. The digital signal processor 702 may then apply the synthesis filtering instructions 714 to combine the frequency sub-bands into an audio signal for transmission to one or more other communication devices via the communication interfaces 722.

Illustrative Operations

Figure 8:
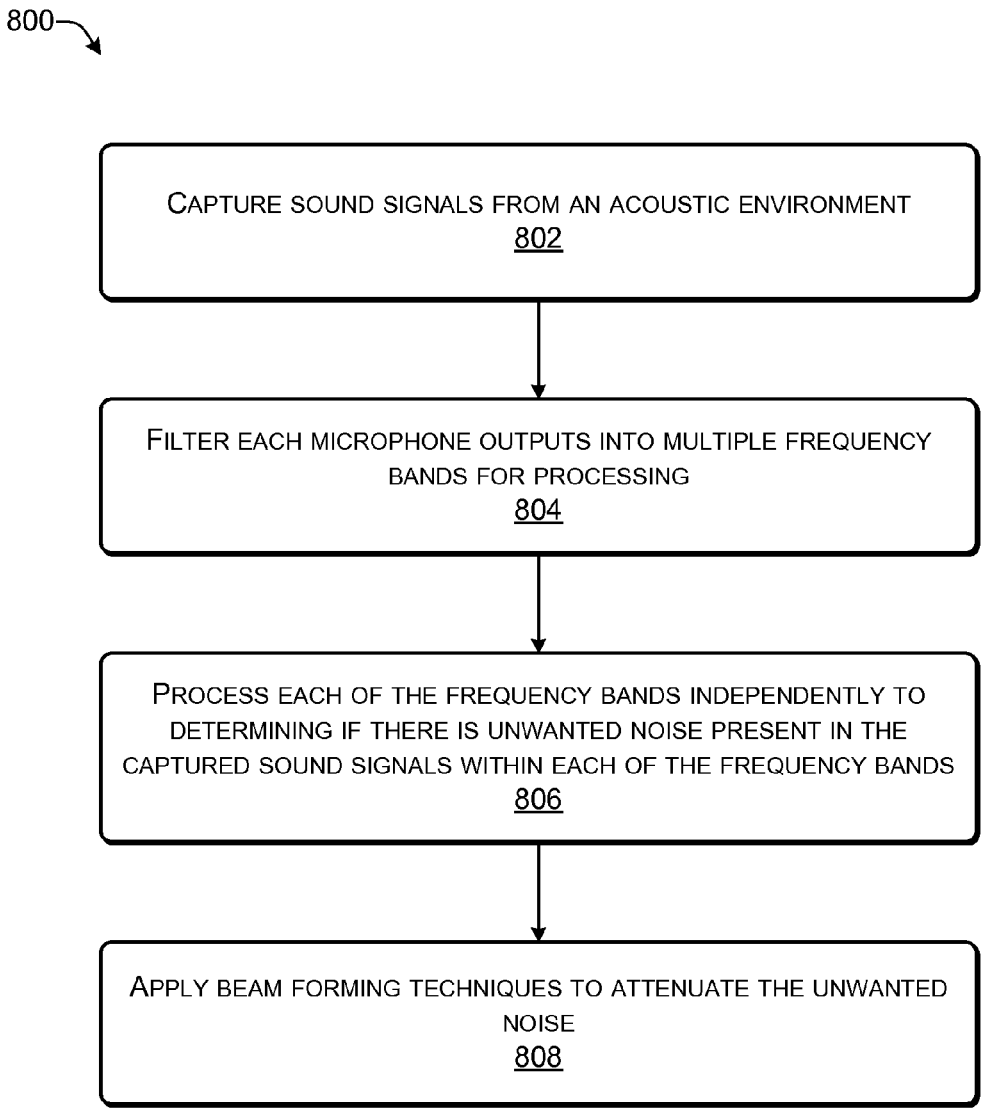
FIG. 8 is a flow diagram illustrating an example process for apply beamforming techniques to multiple frequency sub-bands.
Figure 9:
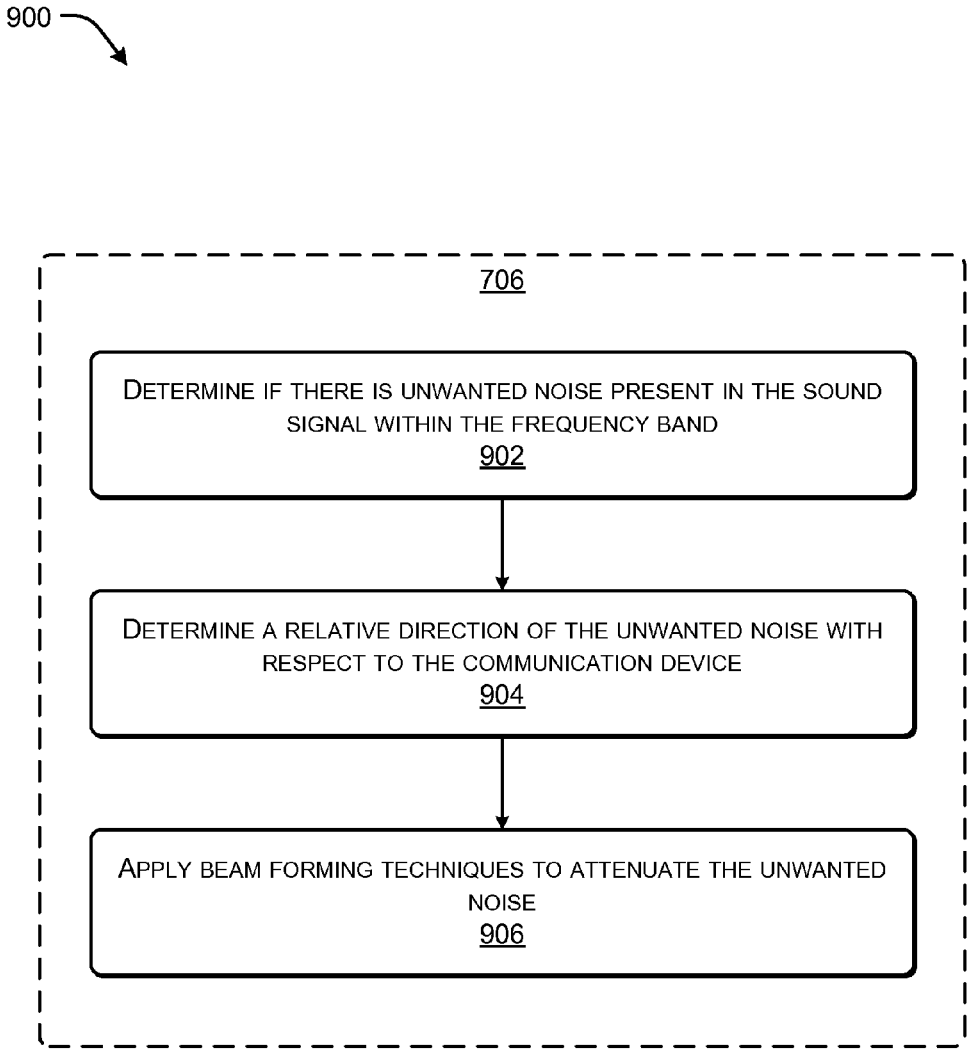
FIG. 9 is a flow diagram illustrating an example process for apply beamforming techniques to a specific frequency sub-band.

FIGS. 8 and 9 are flow diagrams illustrating example processes to form frequency-specific directional acoustical nulls according to some implementations. The processes are illustrated as a collection of blocks in a logical flow diagram, which represent a sequence of operations, some or all of which can be implemented in hardware, software or a combination thereof. In the context of software, the blocks represent computer-executable instructions stored on one or more computer-readable media that, which when executed by one or more processors, perform the recited operations. Generally, computer-executable instructions include routines, programs, objects, components, data structures and the like that perform particular functions or implement particular abstract data types.

The order in which the operations are described should not be construed as a limitation. Any number of the described blocks can be combined in any order and/or in parallel to implement the process, or alternative processes, and not all of the blocks need be executed. For discussion purposes, the processes herein are described with reference to the frameworks, architectures and environments described in the examples herein, although the processes may be implemented in a wide variety of other frameworks, architectures or environments.

FIG. 8 is a flow diagram illustrating an example process 800 for applying beamforming techniques to multiple frequency sub-bands. At 802, a communication device, such as the communication device 102 of FIGS. 1-7, captures microphone signals from an acoustic environment. The communication device may capture the sound signals using a group of microphones, two or more groups of microphones, a microphone array, or multiple microphone arrays.

At 804, the communication device filter each microphone outputs into multiple frequency bands for processing. For example, the communication device may filter the microphone outputs using a plurality of band pass filters, low pass filters, and/or high pass filters. In another example, the communication device may include a digital signal processor and instructions, which cause the digital signal processor to filter the microphone outputs into the multiple frequency bands.

At 806, the communication device processes each of the frequency bands independently to determine if there is unwanted noise present in the captured sound signals within each of the frequency bands. For example, the unwanted noise may only be present within a specific frequency band and attenuation over the entire frequency range results in unnecessary processing.

At 808, the communication device applies beamforming techniques to attenuate the unwanted noise. For example, the communication device may form a frequency-specific directional acoustical null to attenuate the unwanted noise within the frequency band. The frequency-specific directional acoustical null is formed in the microphone outputs in substantially the direction of the source of the strongest unwanted noise from a direction other than the direction of the source of the desired sound signals. In another example, the communication device may also form a frequency-specific directional acoustical beam in substantially the direction of the source of the desired sound signal.

FIG. 9 is a flow diagram illustrating an example process 900 for applying beamforming techniques to a specific frequency sub-band. Generally, a communication device, such as the communication device 102 of FIGS. 1-7, performs steps of process 900 for each of frequency sub-bands. At 902, the communication device determines if there is unwanted noise present in the sound signal within the specific frequency band.

At 904, the communication device determines if there is a relative direction of the unwanted noise with respect to the communication device. For example, the communication device may determine that one of the directional microphones of the microphone array are capturing the unwanted noise and, thus, determine a relative direction of the strongest unwanted noise. In other examples, the communication device may be configured to perform time-based signal processing on microphone outputs to determine a relative angle and direction of the strongest unwanted noise.

At 806, the communication device applies beamforming techniques to attenuate the unwanted noise. For example, the communication device may form a frequency-specific directional acoustical null to attenuate the strongest unwanted noise within the frequency band originating in a direction other than the direction of the source of the desired sound signal. In another example, the communication device may also form a frequency-specific directional acoustical beam in substantially the direction of the source of the desired sound signal.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

The invention claimed is:

1. A method comprising:

capturing sound, at two or more microphones of a device, from an environment;

generating output data based on the sound;

filtering the output data into a plurality of portions, each portion corresponding to one of a plurality of frequency sub-bands; and processing a first portion of the plurality of portions, the first portion corresponding to a first frequency sub-band, the processing comprising:

identifying first audio data in the first portion associated with a user;

determining a first direction related to the first audio data by triangulating a first position of the user relative to the device based on an a first analysis of the output data, the first analysis including determining a first order in which the two or more microphones captured sound associated with the user;

identifying that second audio data is present within the first portion, the second audio data corresponding to a source different from the user;

classifying the second audio data as background noise;

determining that the second audio data is causing a reduction to a speech-to-noise ratio;

determining, using the first portion and a first beamformer, the first beamformer configured to operate on data corresponding to a first frequency sub-band of the plurality of frequency sub-bands, a second direction related to the source by triangulating a second position of the source relative to the device based on a second analysis of the output data, the second analysis including determining a second order in which the two or more microphones captured sound associated with the second audio data, the second direction different than the first direction; and adding a weighted signal to further output of the two or more microphones to determine:

attenuated third audio data corresponding to the first frequency sub-band and the second direction, and amplified fourth audio data corresponding to the first frequency sub-band.

2. The method of claim 1, wherein the weighted signal is based on sound corresponding to the second direction captured by the two or more microphones.

3. The method of claim 1, wherein the first direction is a direction that has previously been associated with the user.

4. The method of claim 1, wherein the first audio data is a highest amplitude audio data within the output data.

5. The method of claim 1, wherein the weighted signal is added to the further output of the two or more microphones based at least in part on a delay.

6. The method of claim 1, further comprising adding the weighted signal to outputs of select microphones of the two or more microphones.

7. The method of claim 1, wherein:

the two or more microphones include at least a first microphone and a second microphone; and the first direction and the second direction are determined based on a delay of sound captured by the first microphone relative to sound captured by the second microphone.

8. A system comprising:

two or more microphones to capture sound and output audio data;

a filter configured to filter the audio data into a first portion corresponding to a first frequency range and a second portion corresponding to a second frequency range different from the first frequency range;

a first beamformer configured to:

operate on the first portion of the audio data but not on the second portion of the audio data, determine first audio data from a first microphone of the two or more microphones corresponds to a sound and was received by the first microphone at a first time, determine second audio data from a second microphone of the two or more microphones corresponds to the sound and was received by the second microphone at a second time, determine a delay between the first time and the second time, determine a first direction based on the delay, attenuate third audio data output by the two or more microphones within the first frequency range in substantially the first direction, determine a second direction corresponds to an estimated position of a user, and amplify fourth audio data within the first frequency range, the audio data corresponding to substantially the second direction; and a second beamformer configured to:

operate on the second portion of the audio data but not on the first portion of the audio data, and attenuate fifth audio data corresponding to sound captured by the two or more microphones within the second frequency range and corresponding to substantially a third direction.

9. The system of claim 8, further comprising an orchestrator to analyze output audio data of the two or more microphones to identify the first direction and the third direction based on the sound captured by the two or more microphones over an entirety of a third frequency range including the first frequency range and the second frequency range.

10. A device comprising:

two or more microphones to capture audio and output audio data;

a filter configured to filter the audio data into a first portion corresponding to a first frequency range and a second portion corresponding to a second frequency range different from the first frequency range;

a first beamformer configured to operate on the first portion of the audio data but not on the second portion of the audio data;

a second beamformer configured to operate on the second portion of the audio data but not on the first portion audio data;

one or more processors for processing output audio data of the two or more microphones; and one or more computer-readable media storing computer-executable instructions which, when executed cause the one or more processors to process the output audio data of the two or more microphones to:

filter output of the two or more microphones into the first portion and the second portion;

identify a first sound signal associated with a user, the first sound signal within the first portion of the frequency range and corresponding to a sound that was received by a first microphone at a first time;

identify a second sound signal associated with the user, the second sound signal within the first portion of the frequency range and corresponding to the sound that was received by a second microphone at a second time;

determine a delay between the first time and the second time, determine a first direction of the first sound signal relative to the device based on the delay, the first direction corresponding to a user;

amplify the first sound signal corresponding to the first direction; and use the second beamformer to attenuate a third sound signal captured by the two or more microphones, the third sound signal within the second frequency range in and corresponding to a direction other than the first direction.

11. The device of claim 10, wherein the first sound signal associated with the user is identified based on a stored voice pattern of the user.

12. The device of claim 10, wherein the first sound signal associated with the user is identified based on a predetermined direction.

13. The device of claim 10, wherein a strongest signal, within the first frequency range, is identified as the first sound signal associated with the user.

14. The device of claim 10, wherein the computer-readable media stores instructions which, when executed by the one or more processors, cause the one or more processors to combine audio from the first frequency range and the second frequency range into an output signal.

15. The device of claim 10, wherein the direction other than the first direction is associated with sources of background noise.

16. The device of claim 10, wherein audio data output by the two or more microphones is attenuated by adding a weighted signal to the output of the two or more microphones.

17. One or more non-transitory computer-readable media storing computer-executable instructions which, when executed by one or more processors, cause the one or more processors to perform acts comprising:

receiving microphone output signals from two or more microphones;

filtering the microphone output signals into a first portion corresponding to a first frequency range and a second portion corresponding to a second frequency range different from the first frequency range;

identifying, within the first portion and using a stored voice pattern of the user, a first sound signal associated with a user;

identifying, within the first portion, a second sound signal not associated with the user; and processing the first portion using a first beamformer configured to operate on data corresponding to the first frequency range but not on data corresponding to the second frequency range, to:

identify a first time that a sound associated with the first sound signal was received by a first microphone, identify a second time that the sound was received by a second microphone, determine a delay between the first time and the second time, determine a first direction associated with the user based on the delay, amplify the first sound signal corresponding to the first direction, and attenuate the second sound signal.

18. The one or more non-transitory computer-readable media of claim 17, wherein identifying the first sound signal is based on a relative energy of sound captured by the two or more microphones represented in the microphone output signals.

19. The one or more non-transitory computer-readable media of claim 17, wherein identifying the first sound signal is based on a known direction.

20. One or more non-transitory computer-readable media storing computer-executable instructions which, when executed by one or more processors, cause the one or more processors to perform acts comprising:

receiving microphone output signals from two or more microphones;

filtering the microphone output signals into a first portion corresponding to a first frequency range and a second portion corresponding to a second frequency range different from the first frequency range;

identifying, within the first portion of the frequency range and using a stored voice pattern of the user, a first sound signal associated with a user from a first direction;

identifying, within the second portion, a second sound signal not associated with the user;

processing the first portion audio using a first beamformer configured to operate on data corresponding to the first frequency range but not on data corresponding to the second frequency range, to:

identify a first time that a sound associated with the first sound signal was received by a first microphone, identify a second time that the sound was received by a second microphone, determine a delay between the first time and the second time, determine the first direction associated with the user based on the delay, and amplify the first sound signal from the first direction; and processing the second portion using a second beamformer configured to operate on data corresponding to the second frequency range but not on data corresponding to the first frequency range, to attenuate the second sound signal.

* * * * *